US012685370B2

(12) United States Patent
Hamada

(10) Patent No.: US 12,685,370 B2
(45) Date of Patent: Jul. 21, 2026

(54) SLIDER FOR SLIDE FASTENER AND SLIDE FASTENER INCLUDING THE SAME

(71) Applicant: YKK Corporation, Tokyo (JP)

(72) Inventor: Yoshikazu Hamada, Toyama (JP)

(73) Assignee: YKK CORPORATION, Tokyo (JP)

( * ) Notice: Subject to any disclaimer, the term of this patent is extended or adjusted under 35 U.S.C. 154(b) by 0 days.

(21) Appl. No.: 18/703,835

(22) PCT Filed: Feb. 16, 2022

(86) PCT No.: PCT/JP2022/006249
§ 371 (c)(1),
(2) Date: Apr. 23, 2024

(87) PCT Pub. No.: WO2023/157146
PCT Pub. Date: Aug. 24, 2023

(65) Prior Publication Data
US 2024/0407509 A1 Dec. 12, 2024

(51) Int. Cl.
*A44B 19/04* (2006.01)

(52) U.S. Cl.
CPC ..... *A44B 19/04* (2013.01)

(58) Field of Classification Search
CPC ... A44B 19/306; A44B 19/308; A44B 19/262; A44B 19/30; A44B 19/04; A44B 19/26;
(Continued)

(56) References Cited

U.S. PATENT DOCUMENTS 4,391,022 A 7/1983 Oda
5,152,036 A * 10/1992 Oda ..... A44B 19/308 24/421
(Continued)

FOREIGN PATENT DOCUMENTS

CN 106307831 A 1/2017
CN 212307032 U 1/2021
(Continued)

OTHER PUBLICATIONS

International Preliminary Report on Patentability in PCT Application No. PCT/JP2022/006249, dated Aug. 20, 2024, 4 pages.
(Continued)

*Primary Examiner* — Jason W San
*Assistant Examiner* — Louis A Mercado
(74) *Attorney, Agent, or Firm* — Procopio, Cory, Hargreaves & Savith LLP

(57) ABSTRACT

Slider includes a slider body with an insertion hole extending toward a lower wing from an insertion entrance on a side of an upper wing so as to form a hollow in the interconnection pillar; a pull tab mounted onto the slider body so as to be pivotable over the upper wing between a collapsed posture and an upright posture; a spring member mounted onto the slider body so as to sandwich a portion of the pull tab; and a cover attached to the slider body so as to cover at least the spring member. The spring member includes a front leg inserted into the insertion hole via the insertion entrance. The cover is configured to include a limiting portion that limits, at a position over the insertion hole, upward displacement of the front leg of the spring member.

20 Claims, 9 Drawing Sheets

(58) Field of Classification Search
CPC ..... Y10T 24/2566; Y10T 24/2571; Y10T 24/2575; Y10T 24/257; Y10T 24/2573
See application file for complete search history.

(56) References Cited

U.S. PATENT DOCUMENTS 5,167,052 A * 12/1992 Aoki ..... A44B 19/306 24/421
5,255,418 A * 10/1993 Chen ..... A44B 19/308 24/421
5,544,394 A * 8/1996 Yaguramaki ..... A44B 19/308 24/424
5,809,622 A * 9/1998 Yaguramaki ..... A44B 19/308 24/421
5,848,455 A 12/1998 Ikehara et al.
5,898,979 A * 5/1999 Hamada ..... A44B 19/306 24/418
5,924,174 A 7/1999 Mizuno
6,009,602 A * 1/2000 Terada ..... A44B 19/306 24/429
6,499,200 B1 * 12/2002 Yamagishi ..... A44B 19/308 24/429
6,591,464 B2 * 7/2003 Lin ..... A44B 19/308 24/421
6,637,078 B2 * 10/2003 Nagata ..... A44B 19/306 24/429
6,769,156 B1 * 8/2004 Chen ..... A44B 19/306 24/429
6,993,810 B2 * 2/2006 Hamada ..... A44B 19/308 24/422
2003/0056342 A1 * 3/2003 Iwase ..... A44B 19/308 24/421
2006/0075611 A1 4/2006 Yamagishi et al.

FOREIGN PATENT DOCUMENTS

DE 69804880 T2 11/2002
JP H09-294612 A 11/1997
JP H10-211006 A 8/1998
JP 2006-102286 A 4/2006
JP 2013-031691 A 2/2013

OTHER PUBLICATIONS

Office Action of German application No. 112022006637.7 dated Mar. 12, 2026.

* cited by examiner

[Fig. 1]
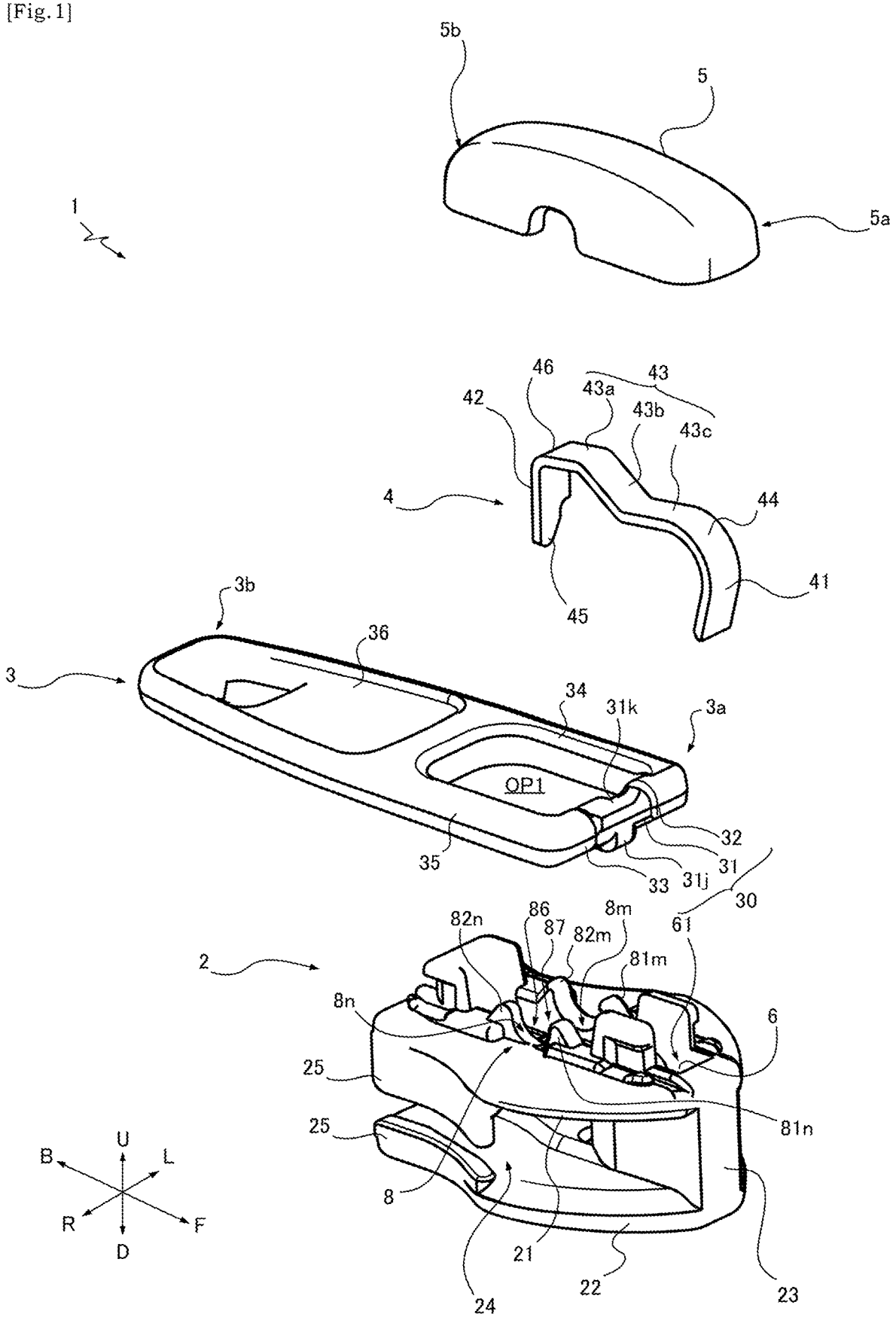

[Fig.2]
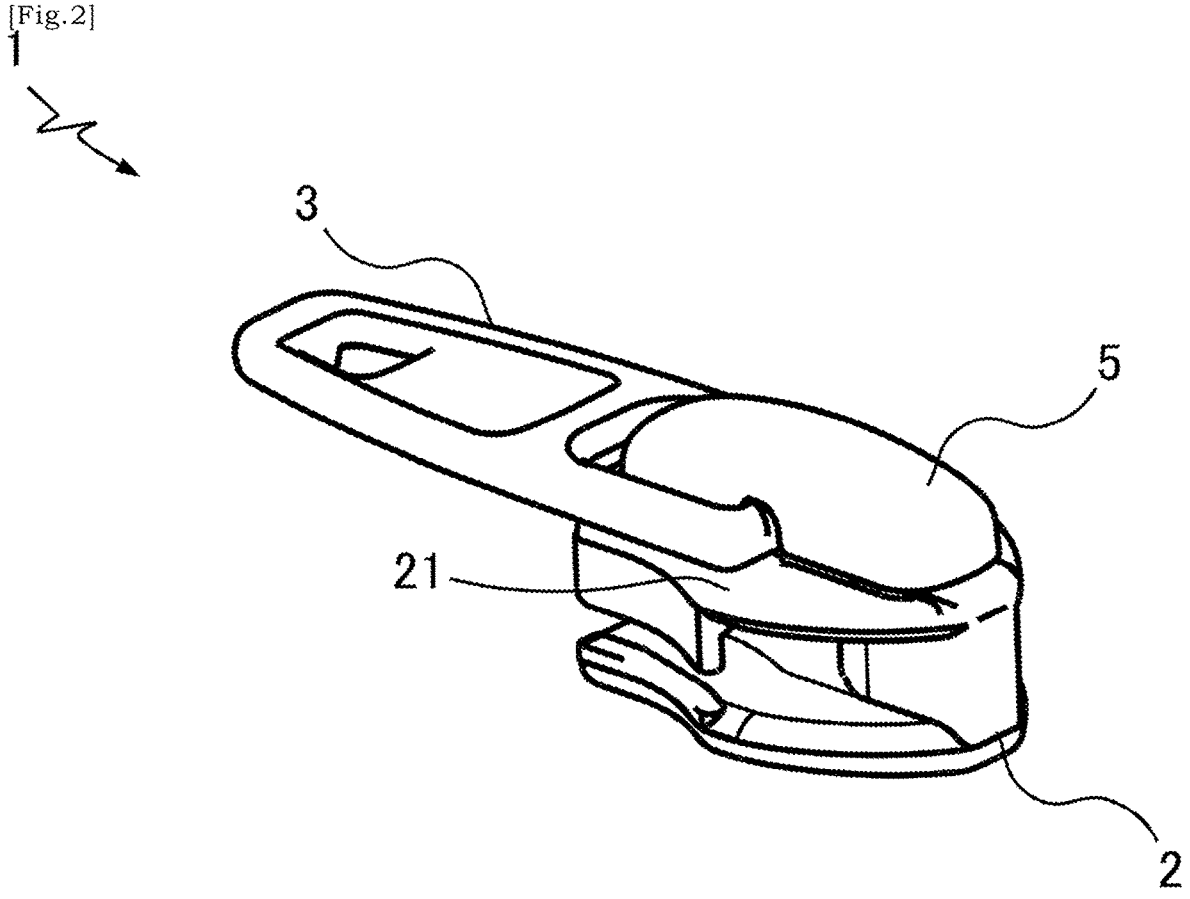

[Fig.3]
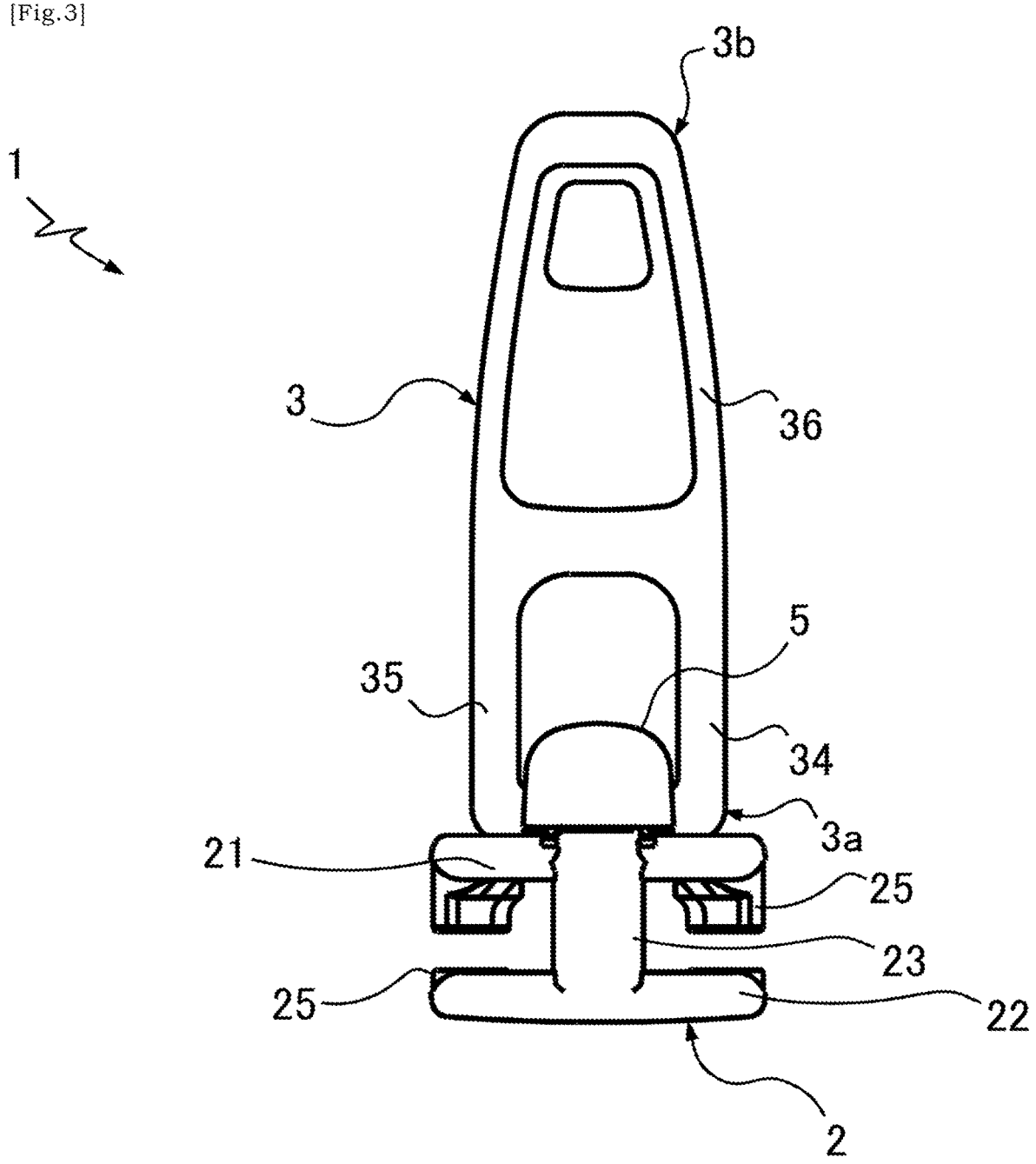

[Fig.4]
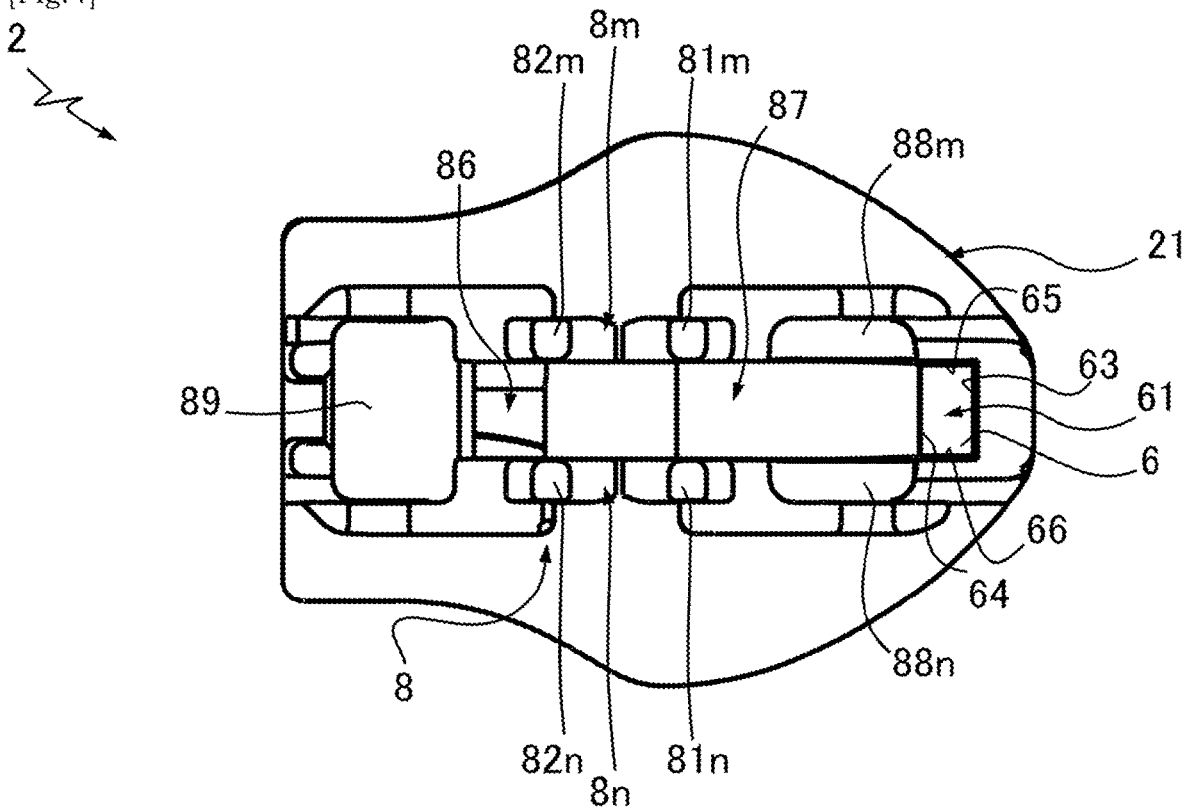
[Fig.5]
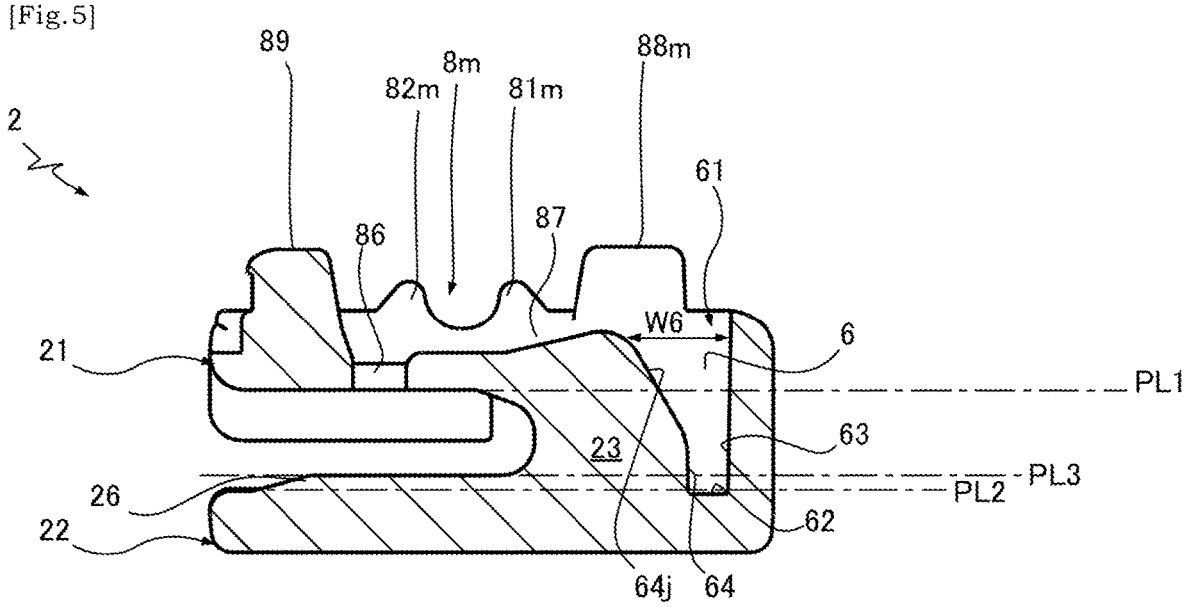

[Fig.6]
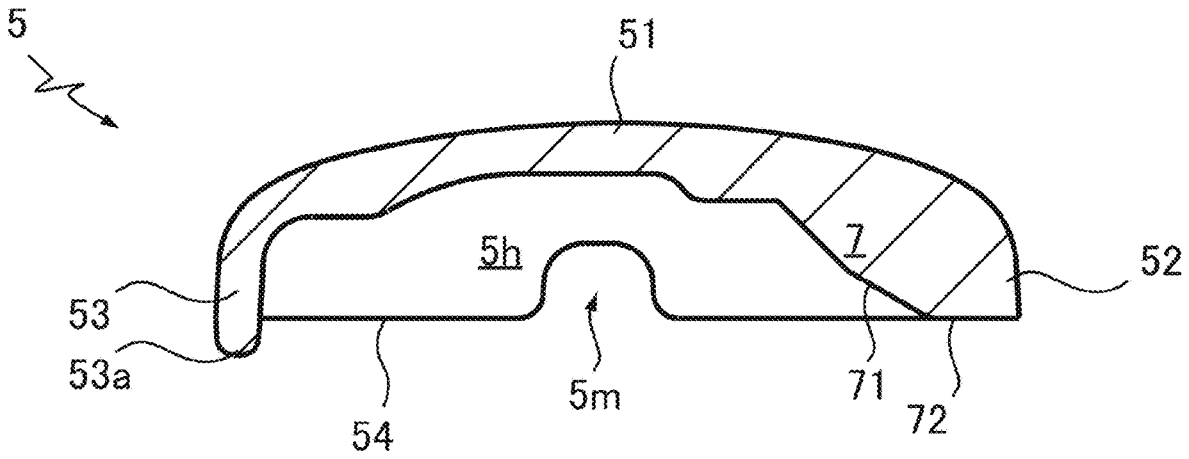
[Fig.7]
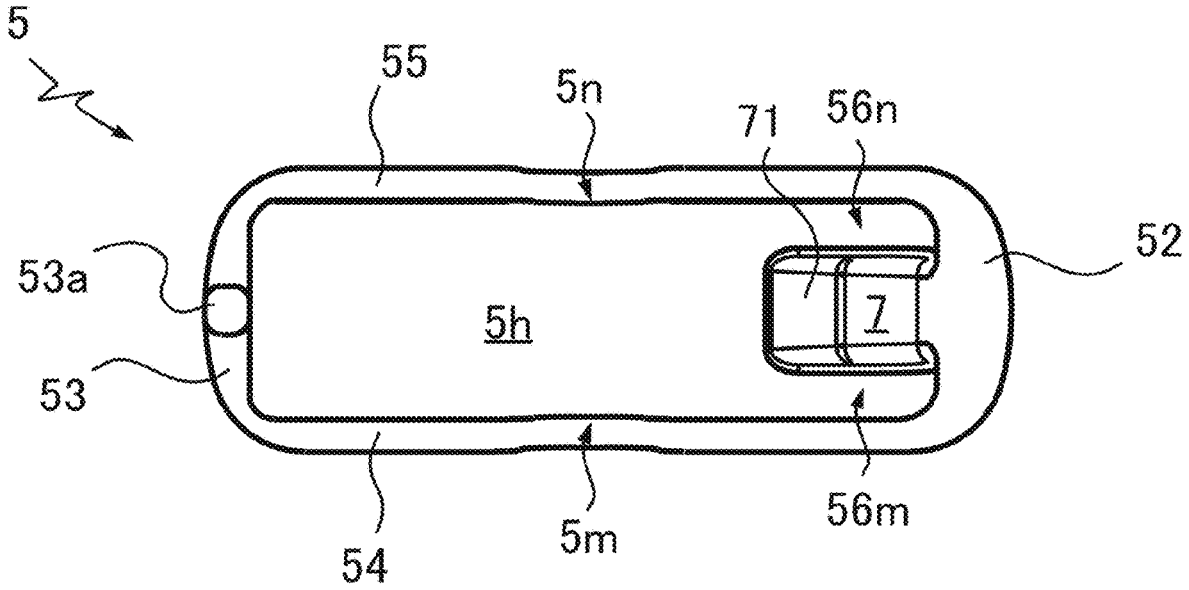

[Fig.8]
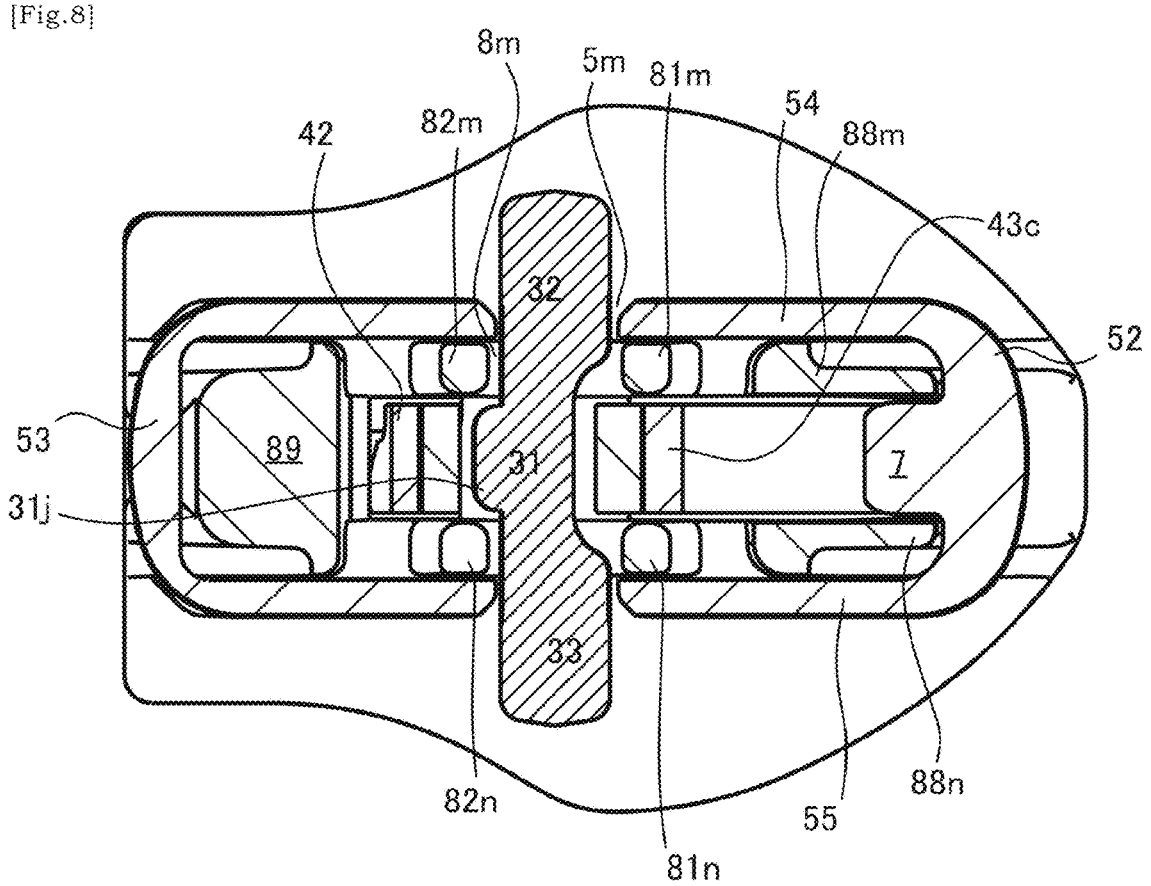
[Fig.9]
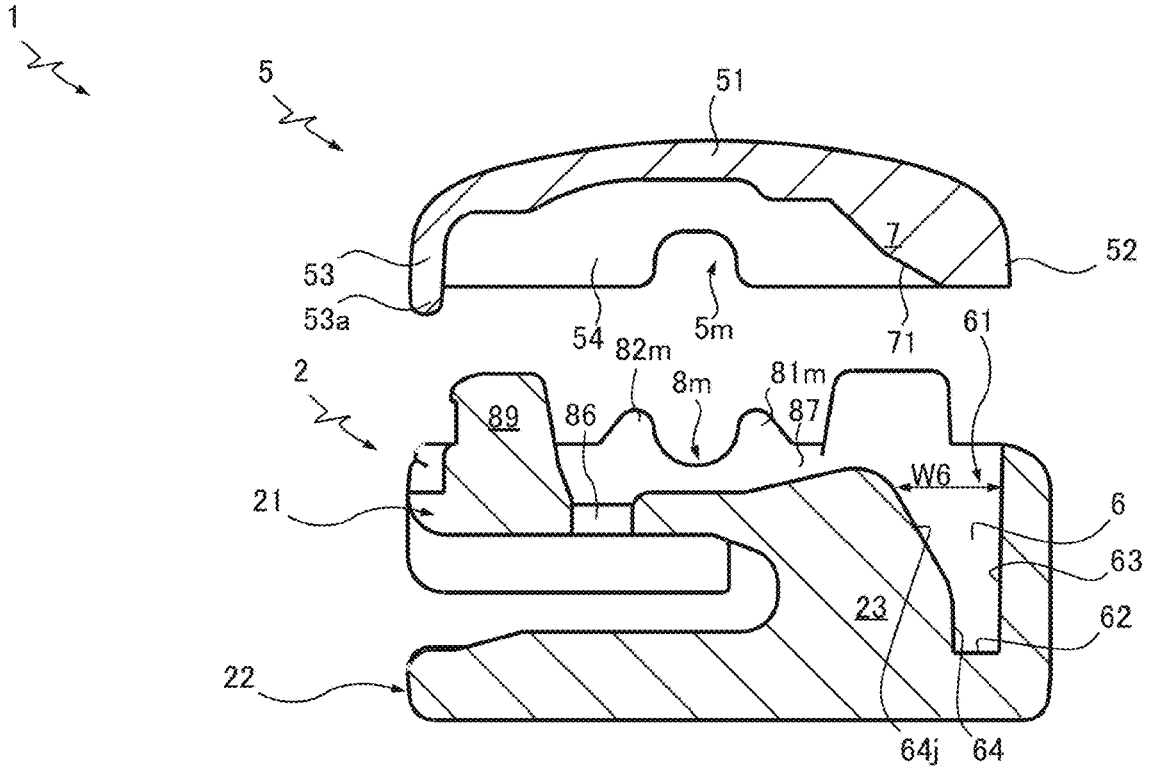

[Fig.10]
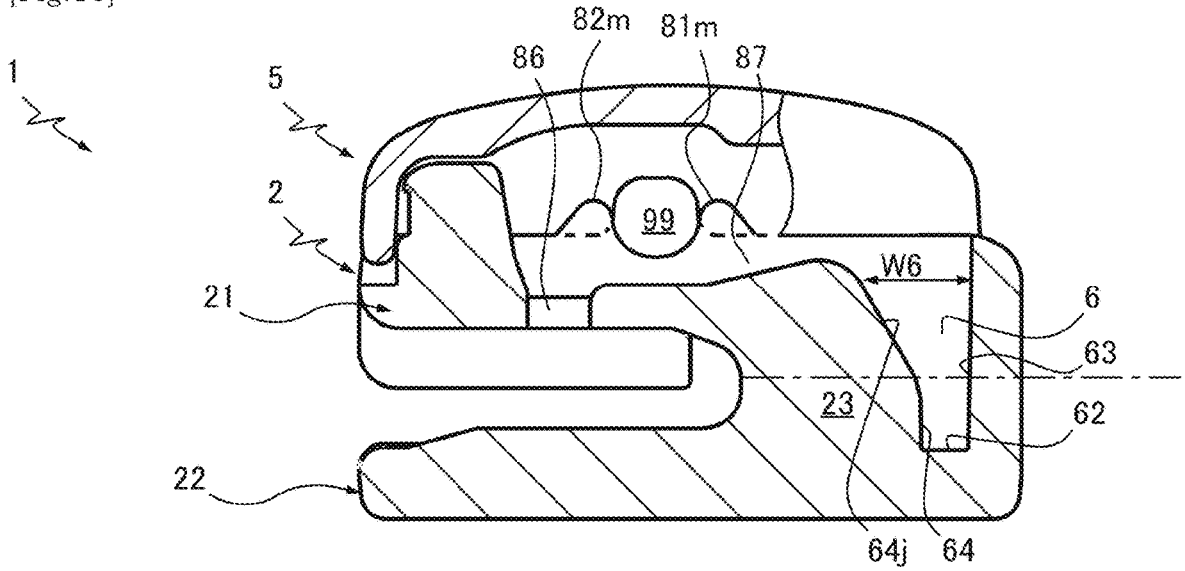
[Fig.11]
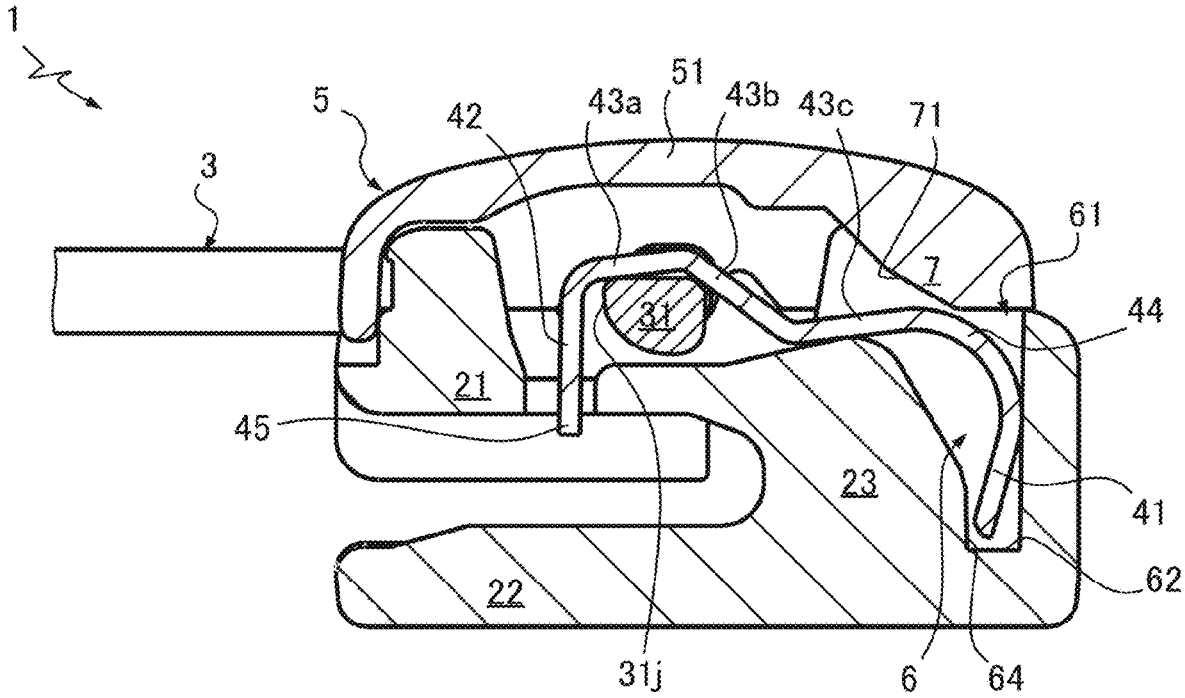

[Fig.12]
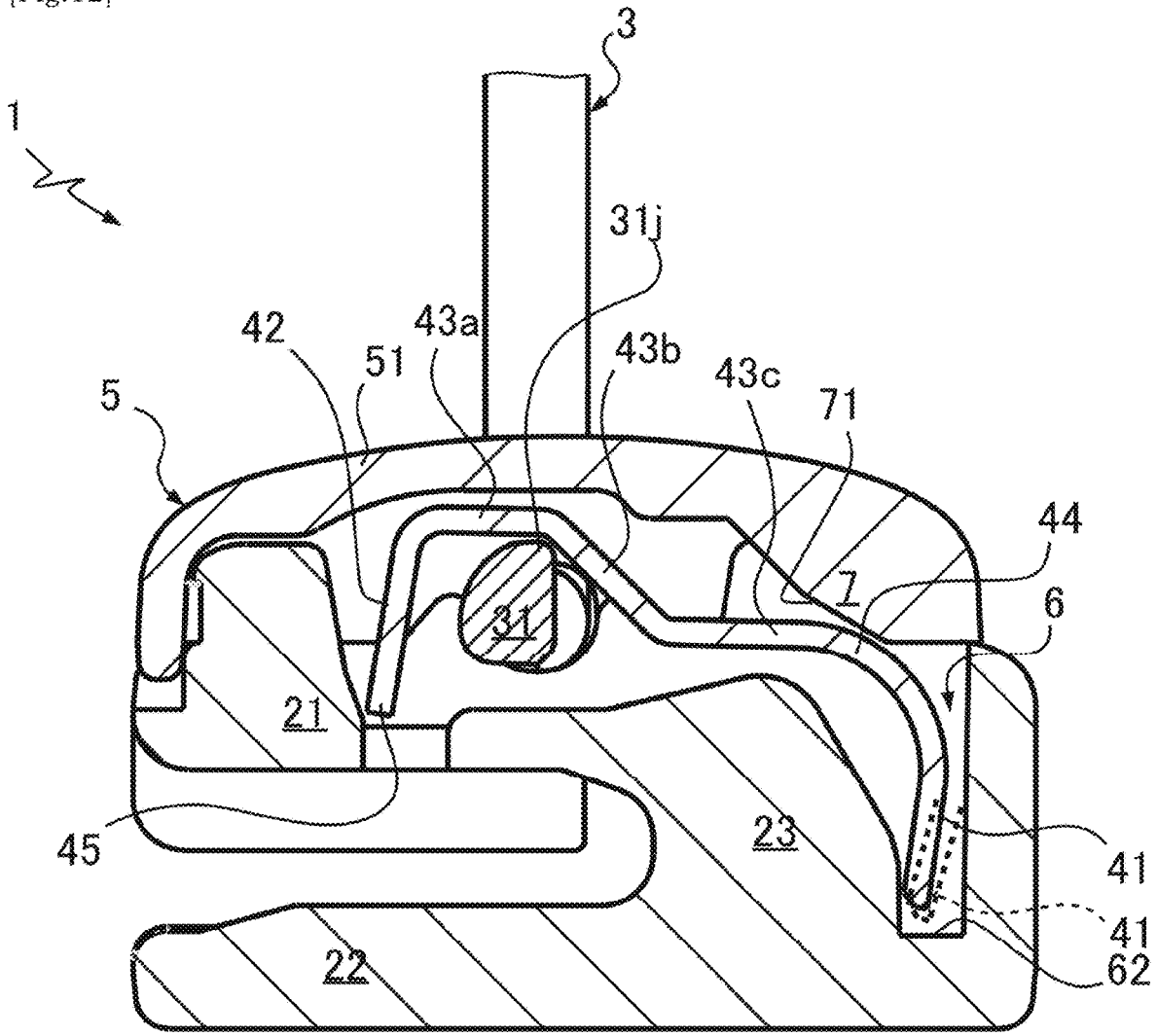
[Fig.13]
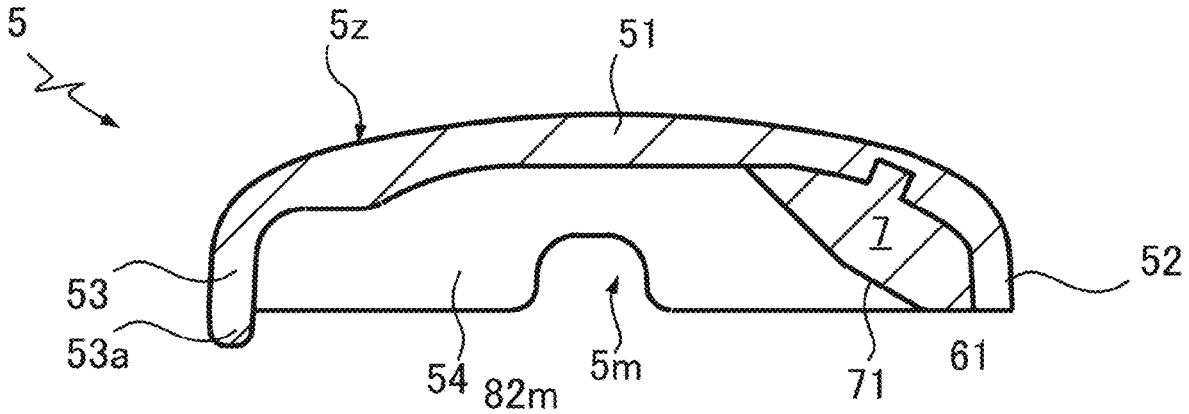

[Fig.14]
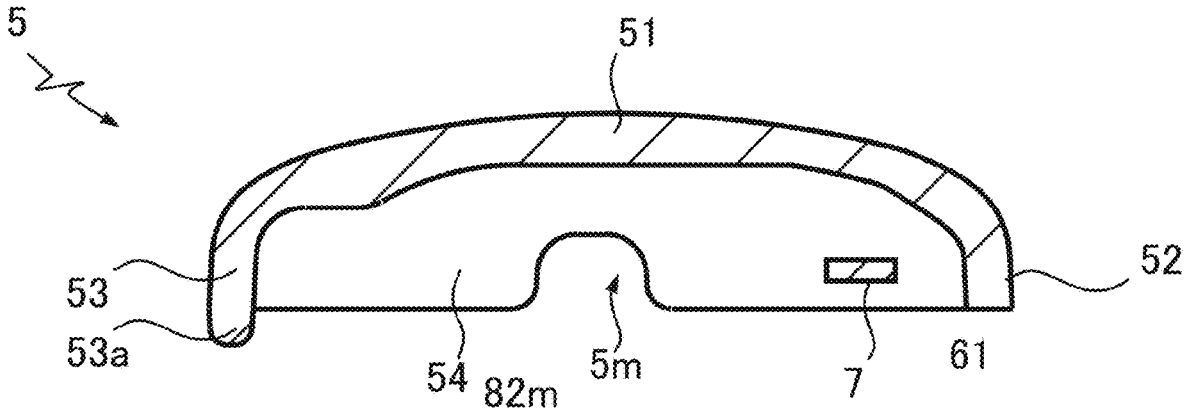

SLIDER FOR SLIDE FASTENER AND SLIDE FASTENER INCLUDING THE SAME

CROSS-REFERENCE TO RELATED APPLICATIONS

This application is a U.S. national stage application of International Application No. PCT/JP2022/006249, filed Feb. 16, 2022, the contents of which are incorporated by reference.

TECHNICAL FIELD

The present disclosure relates to slider for slide fastener and slide fastener including the same.

BACKGROUND ART

PTLs 1-3 disclose that a spring member (a part having a pawl tip for engaging a fastener element) is supported as a cantilever by a slider body alone. In more detail, PTL 1 discloses that a hook portion (See reference number 210) of an elastic part is inserted into a through-hole formed through an interconnection pillar of slider body in up-down direction, and a locked tab (See reference number 211) at a bottom end of the hook portion is locked by a locking portion of the slider body, as would be seen in FIGS. 2 and 3 thereof. PTL 2 discloses that a locking member is attached to a slider body as illustrated in FIGS. 3 and 4 thereof. PTL3 discloses that a stop pawl is secured to a slider body based on swaging at a swaged portion (See reference number 34) of the slider body.

PTL4 discloses that a cover is attached to a slider body such that an elastic part (See reference number 24) of a pawl bar (See reference number 3) is brought into contact with an inner surface of the cover, thus preventing a support axis (See reference number 23) of the pawl bar from displacing off an axial support (See reference number 15), as can be seen in FIGS. 1 and 2 thereof. Note that PTL 4 discloses in its FIGS. 6 and 7 that a cover is provided with a bulged portion (See reference number 33) on its upper inner surface but, this is provided for a purpose of pressing just a leaf spring (See reference number 5) placed on a protrusion (See reference number 12) from above.

CITATION LIST

Patent Literature

[PTL 1] Chinese Utility Model No. 212307032

[PTL 2] U.S. Pat. No. 4,391,022

[PTL 3] Japanese Patent Application Laid-open No. 2013-31691

[PTL 4] Japanese Patent Application Laid-open No. 9-294612

SUMMARY

Technical Problem

It may be desired to realize a simplified method or structure for supporting a spring member as a cantilever than before, thus facilitating production of sliders at reduced cost.

Solution to Problem

A slider for slide fastener according to an aspect of the present disclosure includes: a slider body including: an upper wing, a lower wing, an interconnection pillar interconnecting the upper wing and the lower wing, a passage for fastener elements defined by the upper wing, the lower wing and the interconnection pillar, and an insertion hole extending toward the lower wing from an insertion entrance on a side of the upper wing so as to form a hollow in the interconnection pillar; a pull tab mounted onto the slider body so as to be pivotable over the upper wing between a collapsed posture and an upright posture; a spring member mounted onto the slider body so as to sandwich a portion of the pull tab, the spring member including a front leg, a rear leg, and an intermediate portion extending between the front leg and the rear leg, the front leg inserted into the insertion hole via the insertion entrance, and the rear leg including a pawl tip projectable into the passage for fastener elements via a pawl slot penetrating through the upper wing at a rearward position of the insertion entrance; and a cover attached to the slider body so as to cover at least the spring member. The cover is configured to include a limiting portion that limits, at a position over the insertion hole, upward displacement of the front leg of the spring member. The upward displacement of the front leg of the spring member is limited by the limiting portion at a position over the insertion hole, thus allowing the spring member to operate as a cantilever.

In some embodiments, the limiting portion is arranged locally at a front end of the cover and/or is coupled at least to both of a top plate and a front portion of the cover at the front end of the cover. The limiting portion may have a lower end positioned directly over the insertion entrance without entering the insertion hole and/or the limiting portion includes a slope that is upwardly slanted as extending rearward.

In some embodiments, the cover is a metal part produced through die-cast molding so as to have the limiting portion.

In some embodiments, the slider body is shaped such that the insertion hole has a bottom in the slider body.

In some embodiments, the passage for fastener elements has a width in the up-down direction which is defined by a first plane in which a bottom surface of the upper wing is included and a second plane in which a top surface of the lower wing is included, and the bottom of the insertion hole is positioned in a plane identical to the second plane or lower than the second plane.

In some embodiments, the slider body is shaped such that the insertion hole opens only at the insertion entrance.

In some embodiments, the spring member has a curbed portion curbed between the front leg and the intermediate portion, the limiting portion including a portion positioned directly over the curbed portion of the spring member.

In some embodiments, the curbed portion of the spring member is brought into contact with a slope of the limiting portion while the pull tab shifts from the collapsed posture to the upright posture or when the pull tab takes the upright posture. In some embodiments, a timing of contact between the spring member (e.g. its curbed portion) and the limiting portion may be prior to or simultaneously with a timing when the pull tab is vertically erected relative to the front-rear direction.

In some embodiments, the slider body has a front wall surface and a rear wall surface by which a width of the insertion hole in the front-rear direction is defined, the rear wall surface including a downward slope that approaches the front wall surface as extending downward in a manner that the insertion entrance has a maximum of the width of the insertion hole in the front-rear direction.

In some embodiments, the limiting portion is adapted for fitting between the cover and the slider body. In some embodiments, the cover has a left sidewall and a right sidewall, a left interspace is formed between the limiting portion and the left sidewall, a right interspace is formed between the limiting portion and the right sidewall; and the upper wing is provided with a left protrusion inserted and/or pressed into the left interspace and a right protrusion inserted and/or pressed into the right interspace.

In some embodiments, when the pull tab is in the collapsed posture, said portion of the pull tab interposed between the intermediate portion of the spring member and the slider body is in a condition of being pushed onto the slider body by the intermediate portion of the spring member due to an elasticity of the spring member.

In some embodiments, the spring member is brought into contact with the limiting portion only when the spring member is elastically displaced in accordance with a force applied from the pull tab when the pull tab is operated.

In some embodiments, the portion of the pull tab interposed between the spring member and the slider body includes a cam; the pull tab further includes left and right axial portions arranged on the both sides of the cam; each of the left and right axial portions is received and axially supported in an aperture which is formed by superposition of an upward facing recess formed in the slider body and a downward facing recess formed in the cover.

Also disclosed is a slide fastener including the above-described slider.

Advantageous Effects of Invention

According to an aspect of the present disclosure, a spring member may be supported as a cantilever by simplified method or structure than before.

BRIEF DESCRIPTION OF DRAWINGS

FIG. 1 is a schematic exploded perspective view of slider for slide fastener according to an aspect of the present disclosure.

FIG. 2 is a schematic perspective view of the slider, showing that a pull tab is laid down rearward on an upper wing.

FIG. 3 is a schematic front view of the slider, showing that the pull tab is erected on the upper wing.

FIG. 4 is a schematic top view of the slider body.

FIG. 5 is a schematic cross-sectional view of the slider body, showing a cross section taken at a center of the slider body in width direction.

FIG. 6 is a schematic cross-sectional view of a cover, showing a cross section taken at a center of the cover in width direction.

FIG. 7 is a schematic bottom view of the cover.

FIG. 8 is a schematic cross-sectional view of the slider taken in a plane parallel to a plane in which an upper wing or a lower wing is arranged, showing that the pull tab and a spring member is mounted onto the upper wing, and the upper wing is attached to the cover.

FIG. 9 is a reference schematic view illustrating that the cover is attached to the slider body thereby forming apertures in which an axial portion of the pull tab is received and axially supported.

FIG. 10 is a reference schematic view illustrating that the cover is attached to the slider body thereby forming apertures in which an axial portion of the pull tab is received and axially supported.

FIG. 11 is a schematic cross-sectional view showing that the pull tab is laid down and the spring member is in a locking state.

FIG. 12 is a schematic cross-sectional view showing that the pull tab is erected and the spring member is in an unlocking state.

FIG. 13 is a schematic cross-sectional view of a cover according to another example.

FIG. 14 is a schematic cross-sectional view of a cover according to yet another example.

DESCRIPTION OF EMBODIMENTS

Hereinafter, non-limiting embodiments and features of the present invention would be discussed with reference to drawings. A skilled person would be able to combine respective embodiments and/or respective features without requiring excess description, and would appreciate synergistic effects of such combinations. Overlapping description among the embodiments is basically omitted. Referenced drawings aim mainly for describing inventions and are simplified for the sake of convenience of preparation of drawings. The respective features should be appreciated as universal features not only effective to sliders presently disclosed but also effective to other various sliders not disclosed in the present specification.

FIG. 1 shows an exploded perspective view of a slider 1 for slide fastener. Illustration of slide fastener to which the slider 1 is incorporated is omitted, but left and right fastener elements would be engaged as the slider 1 moves forward and disengaged as the slider 1 moves rearward. In the following descriptions, a direction of movement of the slider 1 for opening and closing slide fastener is defined as a front-rear direction (See a double-headed arrow FB in FIG. 1). A direction orthogonal to the front-rear direction is defined as a left-right direction or a width direction of slider (See a double-headed arrow LR in FIG. 1), and a direction orthogonal to both of the front-rear and left-right directions is defined as an up-down direction (See a double-headed arrow UD in FIG. 1). Note that, the up-down direction does not necessarily indicate a vertical direction (gravity direction). For example, when an elongation direction of slide fastener is orientated in the vertical direction, the up-down direction regarding the slider 1 would be included in a horizontal direction (which is orthogonal to the vertical direction). Directions referred in the present specification is irrelevant to the vertical direction.

As shown in FIG. 1, the slider 1 has a slider body 2 in which a passage 24 for fastener elements is defined by an upper wing 21, a lower wing 22 and an interconnection pillar 23 interconnecting the top and lower wings 21 and 22; a pull tab 3 mounted onto the slider body 2 so as to be pivotable over the upper wing 21 between a collapsed posture (See FIG. 2) and an upright posture (See FIG. 3); a spring member 4 mounted onto the slider body 2 so as to sandwich a cam 31 of the pull tab 3; and a cover 5 attached to the slider body 2 so as to cover at least the spring member 4.

The cover 5 covers the spring member 4 (and a portion of the pull tab 3), thereby enhancing mechanical strength of the slider 1 as a whole and movement of the spring member 4 over the slider body 2 is protected from the outside (e.g. the spring member 4 would not receive any external force and/or would not fall into malfunction due to dusts therein from the outside). At the same time, the slider 1 would have a sophisticated or simpler appearance as shown in FIG. 2. Note that the slider body 2, the pull tab 3, and the cover 5 may be made of resin or metal, and may be produced through die cast molding or injection molding. The spring member 4 may be produced from a metal plate to which processes are applied such as punching and bending, but it does not necessarily be limited to such a metal spring but a resin spring or other types of springs may be employed.

The pull tab 3 has a base end 3*a* and a free end 3*b*, and is pivotable about the base end 3*a*. The pull tab 3 has a rod 30 extending linearly or in a curbed manner along the left-right direction at the base end 3*a* thereof; a pinched portion 36 pinched by fingers of human on the side of the free end 3*b* thereof; an interconnection bar 34 interconnecting the pinched portion 36 and a left end of the rod 30; and an interconnection bar 35 interconnecting the pinched portion 36 and a right end of the rod 30. In the illustrated example, the pull tab 3 has a flat shape but should not be limited to this. An opening OP is formed between the interconnection bars 34 and 35 so that an interference between the pull tab 3 and the cover 5 is avoided owing to the opening OP. The rod 30 includes a cam 31 and left and right axial portions 32 and 33 arranged on the both sides of the cam 31. The cam 31 is provided with a cam boss 31*j* and an optional recess 31*k* at the opposite side of the cam boss 31*j*. The cam boss 31*j* is a portion protruding radially outward relative to the axial portions 32,33. Note that a cam 31 having an oval shape in cross section may be employed. The cam 31 is a portion of the pull tab 3 sandwiched between the spring member 4 and the slider body 2 described above.

The pull tab 3 is pivotable about the slider body 2 as shown in FIGS. 2 and 3. In FIG. 2, the pull tab 3 is in a collapsed posture and the spring member 4 is in the locking state (with a pawl tip 45 described below projecting into the passage 24 for fastener elements), thus preventing the forward and rearward movement of the slider 1. In FIG. 3, the pull tab 3 is in an upright posture and the spring member 4 is in the unlocking state (with the pawl tip 45 described below retracting upward from the passage 24 for fastener elements), thus allowing forward and rearward movement of the slider 1.

The slider body 2 includes an insertion hole 6 extending toward the lower wing 22 from an insertion entrance 61 on the side of the upper wing 21 so as to form a hollow in the interconnection pillar 23 (See FIGS. 4 and 5). The slider body 2 has a front wall surface 63 and a rear wall surface 64 by which a width W6 of the insertion hole 6 in the front-rear direction is defined, and further has a left wall surface 65 and a right wall surface 66 by which a width of the insertion hole 6 in the left-right direction is defined. These wall surfaces 63-66 each extends downward from the insertion entrance 61. The rear wall surface 64 has a downward slope 64*j* that approaches the front wall surface 63 as extending downward in a manner that the insertion entrance 61 has a maximum of the width W6 of the insertion hole 6 in the front-rear direction, thereby ensuring easier insertion of a front leg 41 of the spring member 4 described below into the insertion hole 6. The front wall surface 63 may be a perpendicular surface that is orthogonal to the front-rear direction. The left and right wall surfaces 65 and 66 each may be a perpendicular surface that is orthogonal to the left-right direction. Preferably, the slider body 2 is shaped such that the insertion hole 6 opens only at the insertion entrance 61, not limited to this though. Instead, the insertion hole 6 may be formed so as to penetrate through the slider body 2. Also, the insertion hole 6 may be formed so as to have an opening on the front side.

The slider body 2 may be shaped such that the insertion hole 6 has a bottom 62 in the slider body 2 (i.e. so as not to penetrate through the slider body 2). In other expressions, the slider body 2 may have a bottom surface defining the bottom 62 of the insertion hole 6. In such cases where the insertion hole 6 is formed without penetrating through the slider body 2, the structure of the slider body 2 would be simplified (e.g. mechanical strength of the slider body 2 is enhanced and/or a mold for molding the slider body 2 would be simplified). Note that the bottom surface defining the bottom 62 of the insertion hole 6 may be a flat surface that is normal to the up-down direction.

The passage 24 for fastener elements has a width in the up-down direction which is defined by a first plane PL1 in which a bottom surface (or a lowermost position) of the upper wing 21 is included and a second plane PL2 in which a top surface (or an uppermost position) of the lower wing 22 is included (See FIG. 5), and the bottom 62 of the insertion hole 6 is positioned in a plane identical to the second plane PL2 or lower than the second plane PL2. This allows the insertion hole 6 to have a sufficient length in the up-down direction, facilitating stable mounting of the spring member 4 onto the slider body 2. In cases where a protruded partition 26 is arranged on the top surface of the lower wing 22 at the center in the left-right direction by which a movement passage is partitioned for the left and right fastener elements, the bottom 62 of the insertion hole 6 may be positioned downward of a third plane PL3 where a top surface of the protruded partition 26 is included. Note that the planes PL1-PL3 each is orthogonal to the up-down direction. By way of precaution, the downward slope 64*j* described above crosses the first plane PL1 but does not cross the second plane PL2 (and/or the third plane PL3), thereby facilitating a balance between easier-insertion of the front leg 41 of the spring member 4 and a stable-retaining of the front leg 41 in the insertion hole 6.

Additionally to the upper wing 21, the lower wing 22 and the interconnection pillar 23, the slider body 2 may have left and right flanges 25 by which the Y-shaped passage 24 for fastener elements is delimited in the width direction of the slider. The flange 25 may be located at one or both of the upper and lower wings 21 and 22. The passage 24 for fastener elements extends forward from a single rear mouth of the slider body 2 and diverges by the interconnection pillar 23 into two front mouths.

The upper wing 21 has a pawl slot 86 arranged rearward of the insertion entrance 6 (and the insertion hole 6) described above. The pawl slot 86 penetrates through the upper wing 21 and is in spatial communication with the passage 24 for fastener elements. A groove 87 may be formed on the upper wing 21 which extends between the insertion hole 6 and the pawl slot 86, facilitating easier positioning of the spring member 4 onto the slider body 2.

Left and right axial supports 8*m*,8*n* may be arranged on the top surface of the upper wing 21 for axially supporting the rod 30 of the pull tab 3. Interspace between the axial supports 8*m*,8*n* in the left-right direction may be set such that a portion of the spring member 4 (an intermediate portion 43 described below) is received in-between the axial supports 8*m*,8*n*. When the rod 30 of the pull tab 3 is axially supported by the axial supports 8*m*,8*n*, the cam 31 is positioned between the axial supports 8*m*,8*n* and the axial portions 32,33 are respectively supported by the axial supports 8*m*,8*n*. The axial support 8*m* is a portion of the slider body 2 and provided with an upward facing recess and for example, includes supporting protrusions 81*m*,82*m* aligned in the front-rear direction with an interspace therebetween. The same description applies to the axial support 8*n* (with necessary replacement of the supporting protrusions 81*m*, 82*m* with supporting protrusions 81*n*,82*n*). Note that, as would be obvious from the following descriptions, the rod 30 of the pull tab 3 is axially supported based on corporation of the slider body 2 and the cover 5 without a need of plastic deformation of the axial supports 8*m*,8*n*. In this case, there is no burden in designing an initial shape of the axial support 8*m*,8*n* in light of the plastic deformation, and a possibility may be reduced that insufficient filling of material (metal or resin) happens in connection to the molding of the axial support 8*m*,8*n*.

Plural upward protrusions may be arranged on the top surface of the upper wing 21 for a purpose of attachment of the cover 5 to the slider body 2. For example, a left protrusion 88*m* and a right protrusion 88*n* are arranged forward of the axil supports 8*m*,8*n* on the both left and right sides of the groove 87 described above, with the groove 87 interposed therebetween. Rear protrusion 89 may be arranged adjacent to the pawl slot 86 described above on its rear side. The left protrusion 88*m* may be inserted and/or pressed into a left interspace 56*m* of the cover 5 described below. Similarly, the right protrusion 88*n* may be inserted and/or pressed into a right interspace 56*n* of the cover 5 described below. Similarly, the rear protrusion 89 may be inserted and/or pressed into a space between the left and right sidewalls of the cover 5. Such fitting is not the only way of securing of the cover 5 to the slider body 2, and adhesive or welding or the like would be also available.

Typically, the spring member 4 is not mechanically fastened to the slider body 2 (note that mechanical fastening may be achieved via fitting (e.g. fitting between protrusion and recess, fitting between a hook and a hook stop or the like) or a plastic deformation of the slider body 2). In more particular, the spring member 4 is not supported as a cantilever by the slider body 2 alone, and is just mounted (placed) onto the slider body 2. In this case, it may be possible to employ a simplified shape of the spring member 4 (e.g. a press-process of the front leg 41 for forming a protrusion or recess may be omitted), thus facilitating reduction of the cost thereof (in turn, reduction of the production cost of the sliders 1).

The spring member 4 includes a front leg 41 inserted into the insertion hole 6 via the insertion entrance 61, a rear leg 42 having a pawl tip 45 projectable into the passage 24 for fastener elements via the pawl slot 86 provided in the upper wing 21 rearward of the insertion entrance 61, and an intermediate portion 43 extending between the front leg 41 and the rear leg 42. In some cases, the spring member 4 is curved between the front leg 41 and the intermediate portion 43, and has a curved portion 44 between the front leg 41 and the intermediate portion 43. Furthermore, the spring member 4 is bent between the rear leg 42 and the intermediate portion 43, and has a bent portion 46 between the rear leg 42 and the intermediate portion 43. In this case, the spring member 4 is shaped like a two-humped shape.

The front leg 41 is a flat plate without a dedicated structure for mechanical fastening to the slider body 2 (e.g. protrusion or recess). The rear leg 42 is shaped to have a gradually reducing width in the left-right direction toward its lower end so as to form the pawl tip 45. The intermediate portion 43 is bent or curved at least one location so as to have a pushing portion 43*a* for pushing the cam 31 of the pull tab 3. In the illustrated example, the intermediate portion 43 is bent at the two locations thereby a sloped portion 43*b* and a flat portion 43*c* are formed between the pushing portion 43*a* and the front leg 41. Note that the pushing portion 43*a*, the sloped portion 43*b* and the rear leg 42 define a hump-like frame which opens downward and by which the cam 31 of the pull tab 3 is received. The front leg 41, the curved portion 44 and the flat portion 43*c* define a hump-like frame which opens obliquely downward and rearward and by which a portion of the slider body 2 is pinched, said portion being outlined by the rear wall surface 64 and a bottom surface of the groove 87 (See FIG. 11).

The spring member 4 can recover based on its elasticity from a deformed state (e.g. a state in which the rear leg 42 is moved obliquely upward and rearward away from the front leg 41 (See FIG. 12)) to an initial state (See FIG. 11). Also, the spring member 4 may have a retaining capability between the front leg 41 and the rear leg 42 and in this case, it may be suppressed that the spring member 4 is prevented from easily displacing on the slider body 2 or easily dropping off the slider body 2 when the spring member 4 is mounted onto the slider body 2. The spring member 4 is typically made of a leaf spring made of metal or resin but should not be limited to this.

In the present embodiment, the cover 5 is configured to include a limiting portion 7 that limits, at a position over the insertion hole 6, upward displacement of the front leg 41 of the spring member 4 (See FIGS. 6-9). In more detail, the cover 5 is configured to include the limiting portion 7 that limits, at the position over the insertion hole 6, upward displacement of the front leg 41 of the spring member 4 while allowing the spring member 4 to operate (behave) as a cantilever. Particularly, the spring member 4 is not supported as a cantilever by the slider body 2 alone, but is supported as a cantilever by corporation of the slider body 2 and the limiting portion 7 of the cover 5. This allows simplified method or structure for supporting the spring member as a cantilever than before. In more detail, there is no need to mechanically fasten the front leg 41 of the spring member 4 to the slider body 2 and even if they are so fastened, its required extent or structure may be simplified, thus facilitating production of the sliders at reduced cost. Also, as the cover 5 is attached to the slider body 2, the limiting portion 7 may be positioned in a suitable place relative to the insertion hole 6 or the front leg 41 of the spring member 4 inserted therein. Note that the upward displacement of the front leg 41 of the spring member 4 may be limited based on contact between the spring member 4 and the limiting portion 7.

The cover 5 extends in the front-rear direction so as to have a front end 5*a* and a rear end 5*b*, and also has a cover groove 5*h* that extends in the same direction and opens downward. In more detail, the cover 5 has a top plate 51 and an outer peripheral portion, and the cover groove 5*h* described above is defined by the top plate 51 and the outer peripheral portion (See FIG. 7). The outer peripheral portion is configured, for example, from a front portion 52, a rear portion 53, a left sidewall 54 and a right sidewall 55. The rear portion 53 has a protrusion 53*a* at its lower end for a purpose of positioning of the cover 5 to the slider body 2 but can be omitted.

The limiting portion 7 is arranged locally at the front end 5*a* of the cover 5 and/or is coupled at least to both of the top plate 51 and the front portion 52 of the cover 5 at the front end 5*a* of the cover 5. In this case, a desired operation of the spring member 4 as a cantilever is ensured, and the upward displacement of the rear leg 42 and the intermediate portion 43 (e.g. the pushing portion 43*a*) of the spring member 4 is not (at least largely) impeded. Typically, the limiting portion 7 is arranged forward relative to the center of the cover 5 in the front-rear direction.

In a state where the cover 5 has been attached to the slider body 2, the lower end (e.g. a lower end surface 71 described below) of the limiting portion 7 may not enter into the insertion hole 6 but may be positioned directly over the insertion entrance 61. This avoids or suppresses that the displacement of the front leg 41 of the spring member 4 is excessively impeded. Preferably, one or more of the following conditions are satisfied for the limiting portion 7: (a) the limiting portion 7 is formed as a protrusion inside the cover groove 5*h*; (b) the limiting portion 7 protrudes downward from the top plate 51 of the cover 5; (c) the limiting portion 7 is narrower in width than the cover 5 and/or the cover groove 5*h* in the left-right direction; (d) the limiting portion 7 includes a portion positioned directly over the curved portion 44 of the spring member 4; and (e) the limiting portion 7 does not protrude downward farther than the bottom edge of the left and right sidewalls 54,55 of the cover 5. Preferably, the cover 5 is a metal part produced through die cast molding so as to have the limiting portion 7 (that is, the limiting portion 7 is a metal portion of the cover 5 made of metal). In this case, there is no need to assemble the cover 5 (e.g. it is unnecessary to attach a limiting portion to a cover body).

The limiting portion 7 has a slope 71 that slants upwardly as extending rearward, and a bottom surface 72 that extends forward from a lower end of the slope 71 (See FIG. 6). As the limiting portion 7 has the slope 71 therein, contact or collision between the limiting portion 7 and the intermediate portion 43 of the spring member 4 may be suppressed and the upward displacement of the front leg 41 may be limited in more sufficient extent. The slope 71 may be connected to the inner surface of the top plate 51 at a position forward relative to the center position of the cover 5 in the front-rear direction. The slope 71 is not limited to a form where it slopes at a given angle but may slope at two different angles as in the depicted case. Note that, while the pull tab 3 shifts from the collapsed posture to the upright posture or (at the latest) the pull tab 3 takes the upright posture, the curved portion 44 of the spring member 4 is brought into contact with the slope 71 of the limiting portion 7. The bottom surface 72 typically connects the slope 71 with a bottom or front face of the front portion 52 of the cover 5. Embodiment is envisaged where the slope 71 extends and reaches a lower end of the front face of the front portion 52.

In some embodiments, the limiting portion 7 is adapted for fitting between the cover 5 and the slider body 2. In the illustrated example, a left interspace 56*m* is formed between the limiting portion 7 and the left sidewall 54, and a right interspace 56*n* is formed between the limiting portion 7 and the right sidewall 55. The left protrusion 88*m* on the top surface of the upper wing 21 is inserted and/or pressed into the left interspace 56*m* (See FIG. 8). Similarly, the right protrusion 88*n* on the top surface of the upper wing 21 is inserted and/or pressed into the right interspace 56*n* (See FIG. 8).

The left and right sidewalls 54,55 of the cover 5 have downward facing recesses 5*m*,5*n*. The downward facing recesses 5*m*,5*n* are formed to receive the axial portions 32 and 33 of the rod 30 of the pull tab 3 respectively, each recess defining a space that extends upward from a bottom edge of the sidewall 54,55 on the left or right side (See FIG. 8). Moreover, the downward facing recess 5*m* is positioned adjacent to the axial support 8*m* on the left side, and the downward facing recess 5*n* is positioned adjacent to the axial support 8*n* on the right side. The aperture 99 is formed as a result of such superposition of the axial support 8*m*,8*n* (the upward facing recess) and the downward facing recess 5*m*,5*n* (See FIGS. 8-10). Each axial portion 32,33 of the pull tab 3 is received and axially supported in the aperture 99. As seen in FIGS. 9 and 10, as the cover 5 is attached to the slider body 2, the apertures 99 are formed there-through (in more detail, through the downward facing recess 5*m*,5*n* and the axial support 8*m*,8*n*). Each rim of the axial support 8*m*,8*n* and the downward facing recess 5*m*,5*n* for defining the aperture 99 extends in an arc with a slight interspace along the periphery of the axial portion 32,33. Therefore, the axial portion 32,33 can slide along those rims.

A method of assembling the slider 1 would be apparent for a skilled person in light of the above descriptions. By way of precaution, the pull tab 3 is firstly mounted onto the slider body 2. In more detail, the pull tab 3 is mounted such that the axial portions 32,33 of the pull tab 3 are axially supported by the axial supports 8*m*,8*n* of the slider body 2. Next, the spring member 4 is mounted onto the slider body 2 so as to sandwich the cam 31 of the pull tab 3. The front leg 41 is inserted into the insertion hole 6, and the pawl tip 45 of the rear leg 42 is inserted into the pawl slot 86. The intermediate portion 43 is located over the groove 87, and the cam 31 of the pull tab 3 is sandwiched between the intermediate portion 43 and the bottom surface of the groove 87. The spring member 4 may retain a part of the slider body 2 between the front leg 41 and the intermediate portion 43 (the lower end of the front leg 41 may touch the rear wall surface 64, and the intermediate portion 43 may touch the bottom surface of the groove 87 (See FIG. 11)), but not mechanically fastened to the slider body 2.

Next, the cover 5 is attached and secured to the slider body 2. Through a process of fitting, pressure-fitting, welding or combination thereof, the cover 5 is mechanically fastened to the slider body 2. As described in the foregoing, the cover 5 is provided with the limiting portion 7, and the displacement of the front leg 41 of the spring member 4 is limited simultaneously with the attachment and securement of the cover 5 to the slider body 2. In more detail, the spring member 4 is supported as a cantilever by the corporation of the slider body 2 and the limiting portion 7 of the cover 5. There is no need to mechanically fasten the front leg 41 of the spring member 4 to the slider body 2 and even if they are so fastened, its required extent or structure may be simplified, thus facilitating production of the sliders at reduced cost. As the cover 5 is attached to the slider body 2, the limiting portion 7 may be positioned in a suitable place relative to the insertion hole 6 or the front leg 41 of the spring member 4 inserted therein.

FIG. 11 shows the slider 1 in the locking state when the pull tab 3 is in the collapsed posture. As shown in FIG. 11, the cam boss 31*j* of the cam 31 protrudes rearward; the intermediate portion 43 of the spring member 4, particularly the pushing portion 43*a* pushes the cam 31 downward; and the cam 31 is pushed onto the slider body 2 by the pushing portion 43*a* due to the elasticity of the spring member 4. The pawl tip 45 of the rear leg 42 projects into the passage 24 for fastener elements and is engageable with the fastener element (not illustrated). The engagement between the pawl tip 45 and the fastener element impedes the displacement of the slider 1 in the front-rear direction. When the pull tab 3 is laid down forward, the cam boss 31*j* of the cam 31 protrudes forward not rearward, and the pawl tip 45 of the rear leg 42 projects into the passage 24 for fastener elements, not depicted in drawing though.

FIG. 12 shows the slider 1 in the unlocking state when the pull tab 3 is in the upright posture. As shown in FIG. 12, the cam boss 31*j* of the cam 31 protrudes upward to lift the intermediate portion 43 of the spring member 4, particularly the pushing portion 43*a* upward, and the pushing portion 43*a* comes closer to the top plate 51. In accordance with this displacement of the pushing portion 43*a*, the pawl tip 45 of the rear leg 42 of the spring member 4 is also lifted upward to retract from the passage 24 for fastener elements (also from the pawl slot 86 in some cases). In such a way, the pawl tip 45 is disengaged from the fastener element, allowing the slider 1 to move forward or rearward.

As seen in FIGS. 11 and 12, the spring member 4 in its entirety can be displaced and/or deformed in a limited space between the slider body 2 and the cover 5 in accordance with a force applied from the cam 31 of the pull tab 3 (Dotted line in FIG. 12 shows the lower end portion of the front leg 41 of the spring member 4 depicted in FIG. 11 just for a reference). As the pull tab 3 pivots from the collapsed posture to the upright posture, an interspace between the front leg 41 and the intermediate portion 43 may be increased, thus inviting possible increase in displacement of the spring member 4 relative to the slider body 2 and also allowing the entirety of the front leg 41 of the spring member 4 to be lifted upward slightly in the insertion hole 6. In the present embodiment, the upward displacement of the front leg 41 is limited by the limiting portion 7 of the cover 5 (e.g. by the contact between the limiting portion 7 and the spring member 4). That is, a distance of the upward displacement of the front leg 41 would not be longer in a case where the cover 5 is provided with the limiting portion 7 compared with a case where the cover 5 is not provided with the limiting portion 7 (the distance would be shorter if the limiting portion 7 is in contact with the spring member 4). Therefore, the spring member 4 is allowed to operate like a cantilever without a need of mechanical fastening of the spring member 4 to the slider body 2, thus avoiding or suppressing that the spring member 4 is brought into an impermissible position or posture.

The spring member 4 may be brought into contact with the limiting portion 7 only when the spring member 4 is elastically displaced in accordance with a force applied from the pull tab 3 when the pull tab 3 is operated. That is, it is not a requisite that the spring member 4 (e.g. its curved portion 44) is in contact with the limiting portion 7 in the state shown in FIG. 11, and there may be a slight clearance therebetween. While the pull tab 3 is operated to shift from the collapsed posture (See FIG. 11) to the upright posture (See FIG. 12), the spring member 4 is elastically displaced (or deformed) due to the force applied from the pull tab 3, and the spring member 4 (e.g. its curved portion 44) is brought into contact with the limiting portion 7. The clearance is shut by the contact between the two, and thus limiting further displacement or deformation of the spring member 4 (upward displacement of the front leg 41 or the curved portion 44; or upward displacement of the intermediate portion 43 (e.g. the flat portion 43*c*) away from the front leg 41 (which is in contact with the rear wall surface 64 of the insertion hole 6). Simultaneously, the spring member 4 is allowed to effect a given spring force as being supported as a cantilever.

A timing of contact between the spring member 4 and the limiting portion 7 may be prior to or simultaneously with a timing when the pull tab 3 is vertically erected relative to the front-rear direction (See FIG. 12). In either case, when the pull tab 3 is in the upright posture, the cam 31 of the pull tab 3 is pushed downward by the spring member 4, allowing the pull tab 3 to maintain its posture. Even after an operation of bringing the spring member 4 back into the initial position or posture depicted in FIG. 11, the clearance would emerge between the spring member 4 and the limiting portion 7 in the process. The spread or the extent of the clearance would be adjustable to an appropriate value by a skilled person in the art. Note that, the spring member 4 and the limiting portion 7 may be in contact with one another not only in one place but also in two or more places. Furthermore, the slider 1 may be assembled in a manner that the above-indicated clearance is not formed.

The limiting portion 7 may be made of material different from a cover main body 5*z* of the cover 5. As shown in FIG. 13, the limiting portion 7 may be a part attached to the cover main body 5*z* of the cover 5. In this case, the cover 5 is assembled from the cover main body 5*z* and the limiting portion 7 secured to the cover main body 5*z*. In more detail, the limiting portion 7 is fitted and secured to the cover main body 5*z* in FIG. 13, and a protrusion of the limiting portion 7 is press-fitted to a recess of the cover main body. Needless to say, the recess may be replaced with a through-hole. Also, the limiting portion 7 may be provided with a recess or through-hole, and the cover main body may be provided with a protrusion. It is also possible to fit the protrusion and the recess (a hole portion) at two or more locations. Additionally or alternatively to the fitting, adhesive or welding may be employed.

The limiting portion 7 should not be limited to the downwardly protruding structure from the top plate 51 of the cover, but may be provided so as to bridge the left and right sidewalls 54,55 of the cover 5 or to extend in the left-right direction from a coupled point with one of the left and right sidewalls 54,55 toward the other (See FIG. 14). In FIG. 14, the limiting portion 7 is a flat plate extending in the left-right direction at a position downwardly away from the top plate 51. An interspace between the limiting portion 7 and the top plate 51 in the up-down direction is greater than an interspace between the limiting portion 7 and the bottom edge of the sidewall 54,55 on the left or right side. The cover 5 may be die-cast molded so as to have the flat plate, but other processes may be employed. In either of FIGS. 13 and 14, the limiting portion 7 is locally arranged at the front end 5*a* of the cover 5.

Based on the above teachings, a skilled person in the art would be able to add various modifications to the respective embodiments. Reference codes in claims are just for reference and should not be referred for the purpose of narrowly construing the scope of claims.

REFERENCE CODE

1: Slider
2: Slider body
3: Pull tab
4: Spring member
5: Cover
5*h*: Cover groove
6: Insertion hole
7: Limiting portion
21: Upper wing
22: Lower wing
23: Interconnection pillar
24: Passage for fastener elements
31: Cam
32: Axial portion
33: Axial portion
41: Front leg
42: Rear leg
43: Intermediate portion
45: Pawl tip
61: Insertion entrance
62: Bottom

The invention claimed is:

1. A slider for slide fastener, the slider comprising:

a slider body including: an upper wing, a lower wing, an interconnection pillar interconnecting the upper wing and the lower wing, a passage for fastener elements defined by the upper wing, the lower wing and the interconnection pillar, and an insertion hole extending toward the lower wing from an insertion entrance on a side of the upper wing so as to form a hollow in the interconnection pillar;

a pull tab mounted onto the slider body so as to be pivotable over the upper wing between a collapsed posture and an upright posture;

a spring member mounted onto the slider body so as to fit in a portion of the pull tab, the spring member including a front leg, a rear leg, and an intermediate portion extending between the front leg and the rear leg, the front leg inserted into the insertion hole via the insertion entrance, and the rear leg including a pawl tip projectable into the passage for the fastener elements via a pawl slot penetrating through the upper wing at a rearward position of the insertion entrance; and a cover attached to the slider body so as to cover at least the spring member, wherein the spring member is not mechanically fastened to the slider body and the cover, such that an entirety of the spring member is displaceable in a space between the slider body and the cover in accordance with a force applied from the pull tab when the pull tab is operated, the front leg is shaped as a flat plate, and the cover is configured to include a limiting portion, which is formed as a protrusion inside a cover groove of the cover, that limits, at a position over the insertion hole, upward displacement of the front leg of the spring member, thereby the spring member being supported as a cantilever based on corporation of the slider body and the limiting portion of the cover.

2. The slider of claim 1, wherein the limiting portion is coupled at least to both of a top plate and a front portion of the cover at a front end of the cover, the limiting portion ranging between an inner surface of the top plate of the cover and a lower end of an outer peripheral portion of the cover.

3. The slider of claim 1, wherein the limiting portion includes a slope that is upwardly slanted as extending rearward toward an inner surface of a top plate of the cover from a lower end of an outer peripheral portion of the cover.

4. The slider of claim 1, wherein the cover is a metal part produced through die-cast molding so as to have the limiting portion, and the spring member is a leaf spring, a portion of the slider body being retained between the front leg and the intermediate portion of the spring member.

5. The slider of claim 1, wherein the slider body is shaped such that the insertion hole has a bottom in the slider body, the bottom of the insertion hole being positioned in or lower than a plane including a top surface of the lower wing, and the front leg of the spring member having a lower end positioned in a vicinity of the bottom of the insertion hole.

6. The slider of claim 1, wherein the passage for the fastener elements has a width in an up-down direction which is defined by a first plane in which a bottom surface of the upper wing is included and a second plane in which a top surface of the lower wing is included, and the insertion hole and the front leg cross the first plane.

7. The slider of claim 1, wherein the slider body is shaped such that the insertion hole opens only at the insertion entrance.

8. The slider of claim 1, wherein the intermediate portion having a pushing portion, a sloped portion and a flat portion which are arranged in series between the front leg and the rear leg, the spring member has a curved portion curved between the front leg and the flat portion of the intermediate portion, the limiting portion including a portion positioned directly over the curved portion of the spring member.

9. The slider of claim 8, wherein the curved portion of the spring member is brought into contact with a slope of the limiting portion while the pull tab shifts from the collapsed posture to the upright posture or when the pull tab takes the upright posture.

10. The slider of claim 9, wherein the slider body has a front wall surface and a rear wall surface by which a width of the insertion hole in a front-rear direction is defined, the rear wall surface including a downward slope that approaches the front wall surface as extending downward in a manner that the insertion entrance has a maximum of the width of the insertion hole in the front-rear direction, the slope of the limiting portion and the downward slope of the rear wall surface being opposed with a distance measured in an up-down direction which is reduced rearward due to the downward slope of the rear wall surface.

11. The slider of claim 1, wherein the limiting portion is adapted for press-fitting between the cover and the slider body.

12. The slider of claim 11, wherein the cover has a front portion, a rear portion, a left sidewall and a right sidewall, a left interspace formed between the limiting portion and the left sidewall, a right interspace formed between the limiting portion and the right sidewall, wherein the rear portion has a protrusion at its lower end for positioning of the cover relative to the slider body, and wherein the upper wing is provided with a left protrusion inserted and/or pressed into the left interspace and a right protrusion inserted and/or pressed into the right interspace.

13. The slider of claim 1, wherein when the pull tab is in the collapsed posture, said portion of the pull tab interposed between the intermediate portion of the spring member and the slider body is in a condition of being pushed onto the slider body by the intermediate portion of the spring member due to an elasticity of the spring member.

14. The slider of claim 13, wherein the spring member is brought into contact with the limiting portion only when the spring member is elastically displaced in accordance with the force applied from the pull tab when the pull tab is operated.

15. A slide fastener including the slider of claim 1, in which the front leg, the intermediate portion and the rear leg are serially coupled between first and second ends of the spring member, the spring member having a first curved portion between the rear leg and the intermediate portion and a second curved portion between the intermediate portion and the front leg.

16. The slider of claim 1, wherein the limiting portion is arranged locally at a front end of the cover and is coupled to a top plate and a front portion of the cover at the front end of the cover, the cover groove of the cover is defined by the top plate and an outer peripheral portion of the cover, and the limiting portion ranging across an entire depth of the cover groove at the front end of the cover.

17. The slider of claim 1, wherein the limiting portion is arranged locally at a front end of the cover and is coupled to a top plate and a front portion of the cover at the front end of the cover, the cover groove of the cover is defined by the top plate and an outer peripheral portion of the cover, and the outer peripheral portion of the cover is located over said hollow.

18. The slider of claim 1, wherein the limiting portion has a lower end positioned directly over the insertion entrance without entering the insertion hole and the limiting portion includes a slope that is upwardly slanted as extending rearward.

19. The slider of claim 1, wherein the cover has a left sidewall and a right sidewall, a left interspace formed between the limiting portion and the left sidewall, and a right interspace formed between the limiting portion and the right sidewall.

20. The slider of claim 1, wherein the spring member is brought into contact with the limiting portion only when the spring member is elastically displaced in accordance with the force applied from the pull tab when the pull tab is operated.

* * * * *